US008066341B2

(12) United States Patent
Brüstle

(10) Patent No.: US 8,066,341 B2
(45) Date of Patent: Nov. 29, 2011

(54) ITEM OF FURNITURE

(75) Inventor: Klaus Brüstle, Höchst (AT)

(73) Assignee: Julius Blum GmbH, Hochst (AT)

( * ) Notice: Subject to any disclaimer, the term of this patent is extended or adjusted under 35 U.S.C. 154(b) by 87 days.

(21) Appl. No.: 11/896,724

(22) Filed: Sep. 5, 2007

(65) Prior Publication Data

US 2008/0122332 A1 May 29, 2008

Related U.S. Application Data

(63) Continuation of application No. PCT/AT2006/000117, filed on Mar. 20, 2006.

(30) Foreign Application Priority Data

Mar. 21, 2005 (AT) ..... A 478/2005

(51) Int. Cl.
*A47B 95/02* (2006.01)

(52) U.S. Cl. ..... 312/319.5; 312/327

(58) Field of Classification Search ..... 312/319.5, 312/319.6, 319.7, 319.8, 325, 327, 328, 319.2, 312/116; 49/139, 140, 339, 340, 345; 16/286, 16/287, 288

See application file for complete search history.

(56) References Cited

U.S. PATENT DOCUMENTS

| | | | | |
|---|---|---|---|---|
| 2,912,237 | A * | 11/1959 | Snyder | 49/199 |
| 5,524,979 | A * | 6/1996 | Carson et al. | 312/319.2 |
| 5,564,228 | A * | 10/1996 | Geringer et al. | 49/32 |
| 5,727,348 | A * | 3/1998 | Arnell et al. | 49/25 |
| 5,755,496 | A | 5/1998 | Hahn | |
| 5,904,411 | A * | 5/1999 | Hayakawa | 312/319.2 |
| 7,178,202 | B2 * | 2/2007 | Hirtsiefer et al. | 16/366 |
| 7,500,287 | B2 * | 3/2009 | Brustle | 16/286 |
| 2002/0008400 | A1 | 1/2002 | Hess et al. | |
| 2005/0017224 | A1 * | 1/2005 | Salice | 254/1 |

FOREIGN PATENT DOCUMENTS

| | | |
|---|---|---|
| DE | 27 17 196 | 11/1978 |
| DE | 36 05 637 | 10/1986 |
| DE | 101 45 856 | 4/2003 |
| DE | 102 23 026 | 2/2004 |
| JP | 2004-300687 | 10/2004 |
| WO | 2004/100718 | 11/2004 |

* cited by examiner

*Primary Examiner* — James O Hansen

*Assistant Examiner* — Matthew Ing

(74) *Attorney, Agent, or Firm* — Wenderoth, Lind & Ponack, L.L.P.

(57) ABSTRACT

A piece of furniture including a body and at least one flap that can be upwardly displaced by means of at least one actuating arm which is joined to the flap in an articulated manner and can preferably be pivoted about a horizontal axis. At least one actuating arm is subjected to the action of a spring device, and at least one electric drive acts on at least one actuating arm. A coupling device acts between the electric drive and the actuating arm, said coupling device having a free wheel for freely displacing the actuating arm into an open position and/or a closed position, in at least one rotary direction over a defined angular region.

40 Claims, 11 Drawing Sheets

Figure 1:
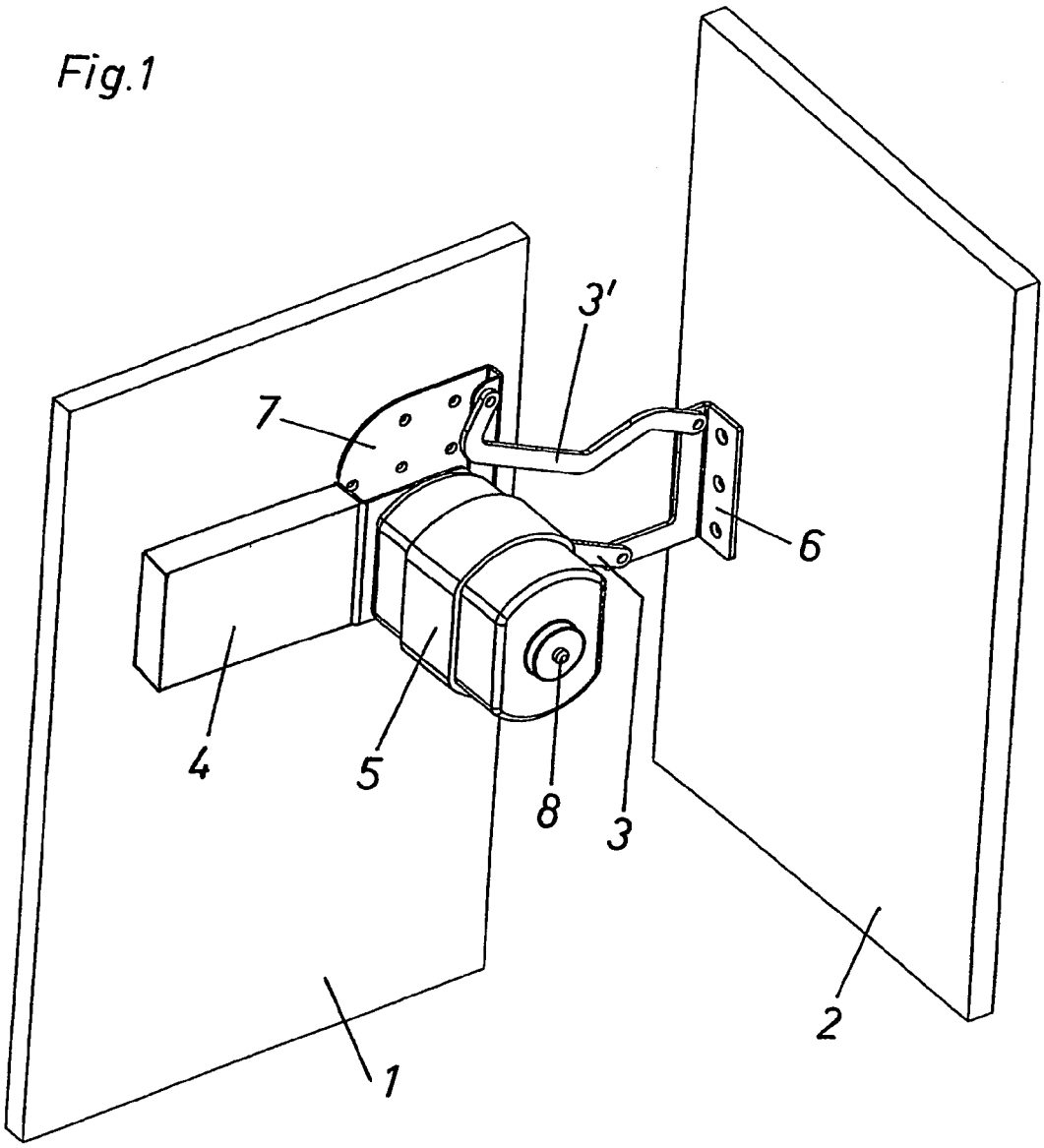

1
2
2'
23
24
25
30
33
34

ITEM OF FURNITURE

This is a Continuation Application of International Application Number PCT/AT2006/000117, filed on Mar. 20, 2006.

BACKGROUND OF THE INVENTION (1) Field of the Invention

The present invention relates to an item of furniture having a furniture body and at least one flap being upwardly movable by means of an actuating arm which is connected to the flap and acted upon by a spring device, wherein the actuating arm is preferably pivotable about a horizontal axis and wherein further an electric drive device is provided which can act upon the actuating arm.

(2) Description of Related Art

According to the prior art, various designs of items of furniture are known which have a setting device for moving a flap upwardly. DE 102 23 026 describes a cover setting device for a cupboard, whereby a flap can be swung parallel to the front side of the item of furniture and also across thereto. In order to retain the flap in any desired open position, a spring device is provided which has an adjustable sliding member in order to act upon the actuating arm.

BRIEF SUMMARY OF THE INVENTION

It is an object of the present invention to provide an item of furniture of the type referred to above which improves the intuitive operability of the movable flap.

In the present invention, this object is achieved by providing a coupling device which can operate between the electric drive device and the actuating arm, wherein the coupling device allows the actuating arm to move freely across a limited pivoting range in an open position and/or in a closed position in at least one direction of rotation.

By means of the arrangement or effect of the electric drive device referred to above, the movement of the flap which opens upwards can be at least partially supported by the electrical drive device, and in the case of heavy flaps with a large surface area, the operability can be facilitated. A flap which is in a fully open position in a spatially high location can often only be reached with difficulty and the manipulation of this flap is significantly facilitated by the electric drive device. Advantageously, it is provided that the electric drive device acts on the same actuating arm or lever which is also acted upon by the spring device.

The arrangement of the pressurised actuating arm with the electric drive device may also be provided on both sides of the flap or on both furniture side walls of the cabinet. It might, however, also be sufficient to fit an electric drive device to only one side of the flap or of the item of furniture.

By arranging the coupling device in the manner described above, a motorised movement of the actuating arm can be achieved, wherein the electric drive device preferably only operates across a partial range of the pivotal distance of the actuating arm. This can, for example, allow the motor to supply a starting impulse which will provide the actuating arm a sufficient torque via the coupling device so that the flap can be moved into the respective end positions without any additional motorised support, only by means of the force of the spring device which acts upon the actuating arm.

A preferred embodiment of the invention provides for the spring device to pressurise the actuating arm such that the flap is basically retained in any pivoting position against the force of gravity. The spring device serves to compensate the weight of the flap so that the flap is essentially self-supporting. To achieve this, all measures and arrangements according to the prior art may be applied here, including the actions and layouts, whether in terms of distances between axes as, for example, described in DE 101 45 856, by suitable actuating arm pivot points with reference to the flap, by spring mechanisms with varying ratios of transmission, by adjustable sliding valves, control cams with control contours or by similar means. It is, however, provided that the spring device can be adjustable in order for the torque applied on the actuating arm can be varied.

In connection with this invention, "spring devices" should be understood to refer not only to spring mechanisms with mechanical spring components but also to all other known power stores such as gas pressure stores or the like. It is also possible to provide power from an external energy source, for example, that of the electric drive, to form at least part of the spring device.

In designing the electric drive device it may be useful if the torque which is to be supplied to the adjustable arm by the electric drive in order to open the flap is essentially equal to the moment of inertia of the flap multiplied by the angular acceleration of the flap which is to be obtained. For a flap which has been ideally put in balance, this means that the electric drive has only to provide minimal power. A minimally structured electric motor can therefore be designed which shall guarantee operation without any problems while using little power.

A further embodiment of the invention provides that an actuating device may be arranged in order to move the flap, wherein the actuating device comprises a base structure adapted to be fitted to the body of furniture. The actuating arm is on the one hand pivotably mounted to the base structure and on the other hand articulated to the flap. There a numerous known designs of these actuating devices in the prior art which can be advantageously combined with the scope of the present invention. The base structure (core) is normally fitted to a lateral wall of the item of furniture. A spring device pressurises the actuating arm connected to the base structure by means of setting devices. Advantageously, the flap can be moved by the actuating device from the fully closed position to an open position or in the opposite direction. One embodiment of the invention provides for the actuating arm to be arranged on the basic structure on a bearing axis. In this connection it is convenient if the electric drive device is arranged substantially coaxially to the bearing axis of the actuating arm. This can enable a central pivot point which will, in addition, require few construction components, so permitting the actuating device to be simply realised as a structural feature.

One embodiment of the invention provides that the electric drive device can be connected—at least temporarily—to the actuating arm. For this purpose, a transmission may be arranged which can be equipped—in the event that structural conditions are required—with a gear or a gear reduction. Also a coupling mechanism may be provided which includes gear teeth, friction linings or the like. Due to the minimally required torque of the electric drive and the small structural size resulting from this, it can usefully be fitted inside a casing or in or onto said base structure of the actuating device.

A further embodiment of the invention provides that a second flap may be provided which is articulated about a horizontal axis with respect to the first flap. This type of arrangement is known as bi-fold lids which can be used for cover elements of upper cupboards in kitchens. The actuating arm is advantageously articulated to the lower second flap for easier mobility and for more stable guidance of the flap.

In accordance with the state of art, there are flaps which are known as so-called swivel flaps, where the connected furniture flap can be swung backwards across beyond the furniture body. Also known are so-called lift flaps, where the furniture flap can be moved substantially parallel to the front face of the furniture body across the entire opening and closing movement path. It is also within the scope of invention to combine above-mentioned flaps with the concept of the present invention.

Advantageously the flap can be moved from an open to a fully closed position over at least a part of the movement path by means of the electric drive. It can also be advantageous if the flap can be moved to a fully open position over at least a part of the movement path by the electric drive. This enables the flap to be brought into the respective end position, wherein this movement can be damped. For this purpose the electrical drive itself can be provided to achieve a dampened motion of the flap.

A number of design features are conceivable and possible in order to activate the electric drive. The electric drive can, for example, be activated by a switch device, preferably a push-button switch. It may be practical that the switch device is arranged on or in the item of furniture or spatially outside thereof. This type of switch device significantly facilitates the process since the weight of the flap can often be more than 20 kg. The switch device can also activate the electric drive by wireless transmission means.

Alternatively or as an addition, it can be useful if the electric drive can be activated by a manual movement of the flap, in which the electric drive can be activated by pulling or pushing the flap. These types of functions are known as touch-latch functions, where the flap can be moved into the fully open as well as the fully closed position by being pulled or pushed. Accordingly, it is not necessary to provide handles or holding components on the flap.

Alternatively or as an addition to the aforementioned possible forms of activation, it may be an advantage for the electric drive to be activated by a sensor device, preferably a contactless sensor device. A further design feature provides for the electric drive to be verbally activated by a speech recognition device. Activation of the electric drive may also be performed by an optical detecting device, preferably a camera.

Advantageously the electric drive comprises an electric motor, preferably a direct current motor, and a transmission gear. The direct current motor may also be designed as a linear motor.

With regard to the energy supply, it is an advantage if the electric drive is supplied with power by a power store, preferably a battery. An external power supply can also be provided by the normal domestic power grid.

For a smooth and regular process of movement it can be an advantage if at least one damper device is provided in order to dampen the movement of the flap. For this purpose, bumpers, linear or rotation dampers or the like may be used. A useful design feature is, however, provided so that the damper device is at least partly formed from the electric drive while the damping action can also fully be effected by the motor. In order to reduce the loud noise of closing and any mechanical overstraining of the system components, it may be an advantage if the damper device at least dampens the movement of the flap over the last opening section and/or at least over the last closing section of the flap.

Further details and advantages of this invention will be explained in greater detail by the description given in the following figures and by reference to the drawings.

DETAILED DESCRIPTION OF THE DRAWINGS

Figure 2A:
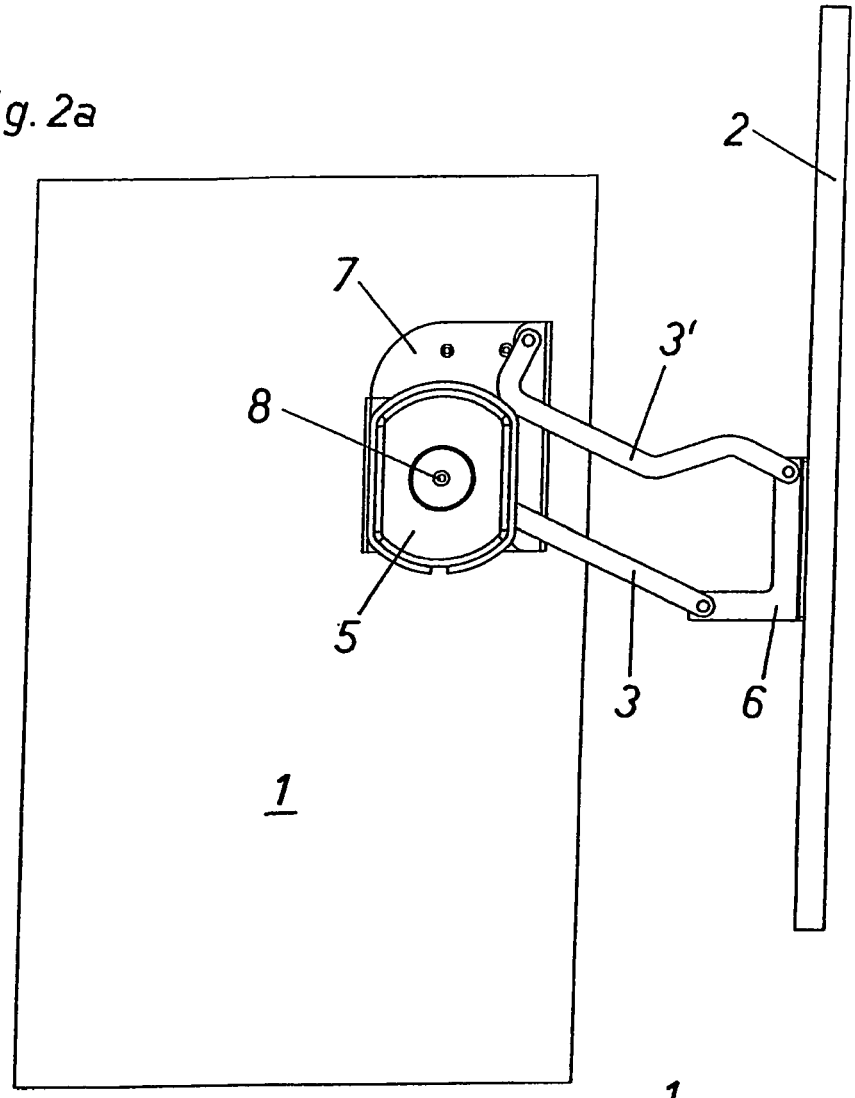
Figure 2B:
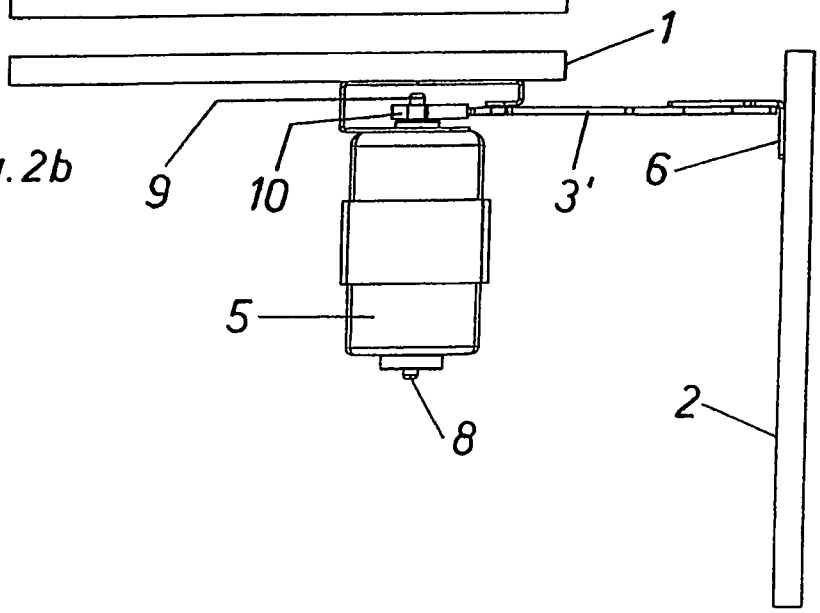
Figure 3:
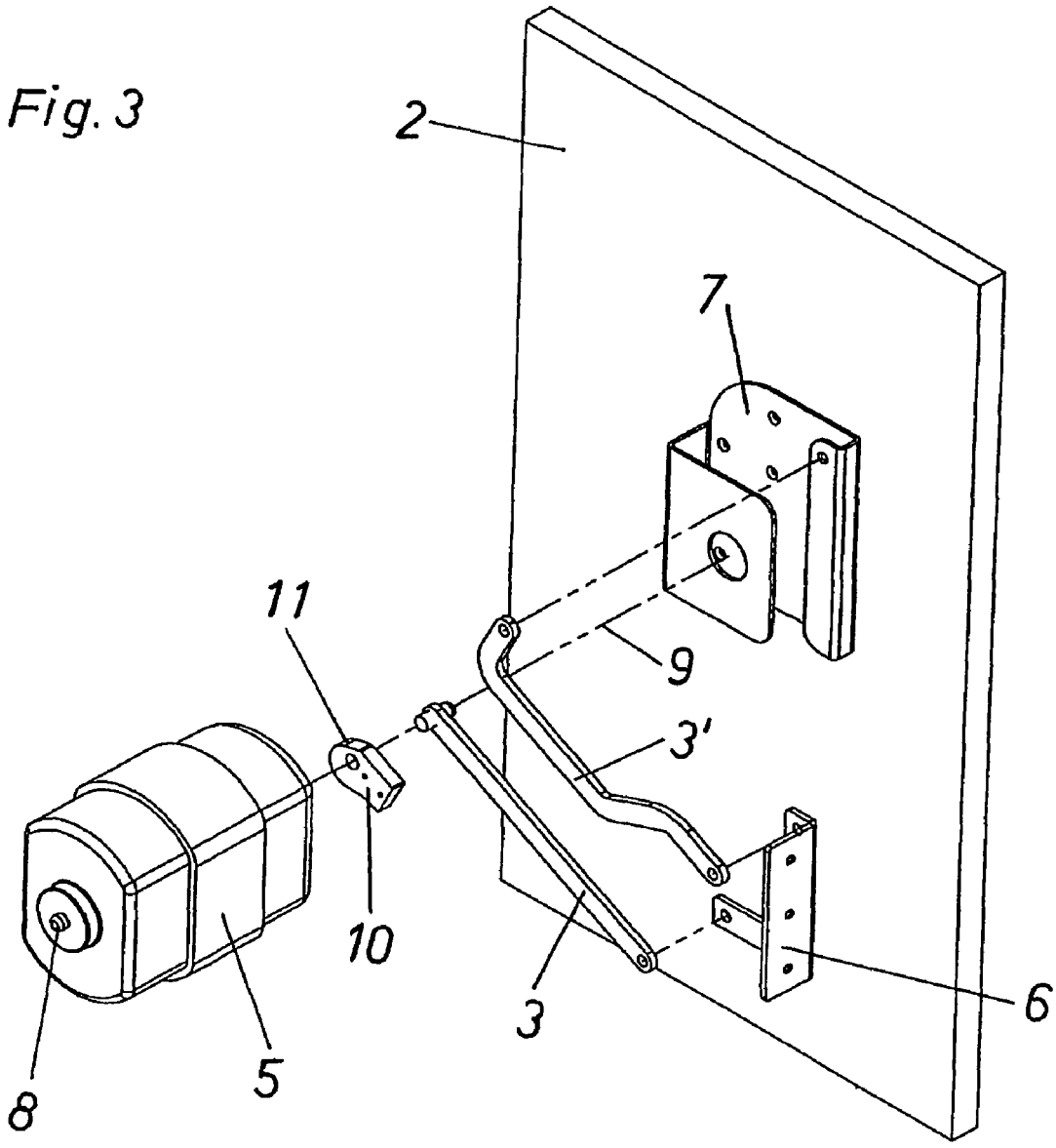
Figure 4A:
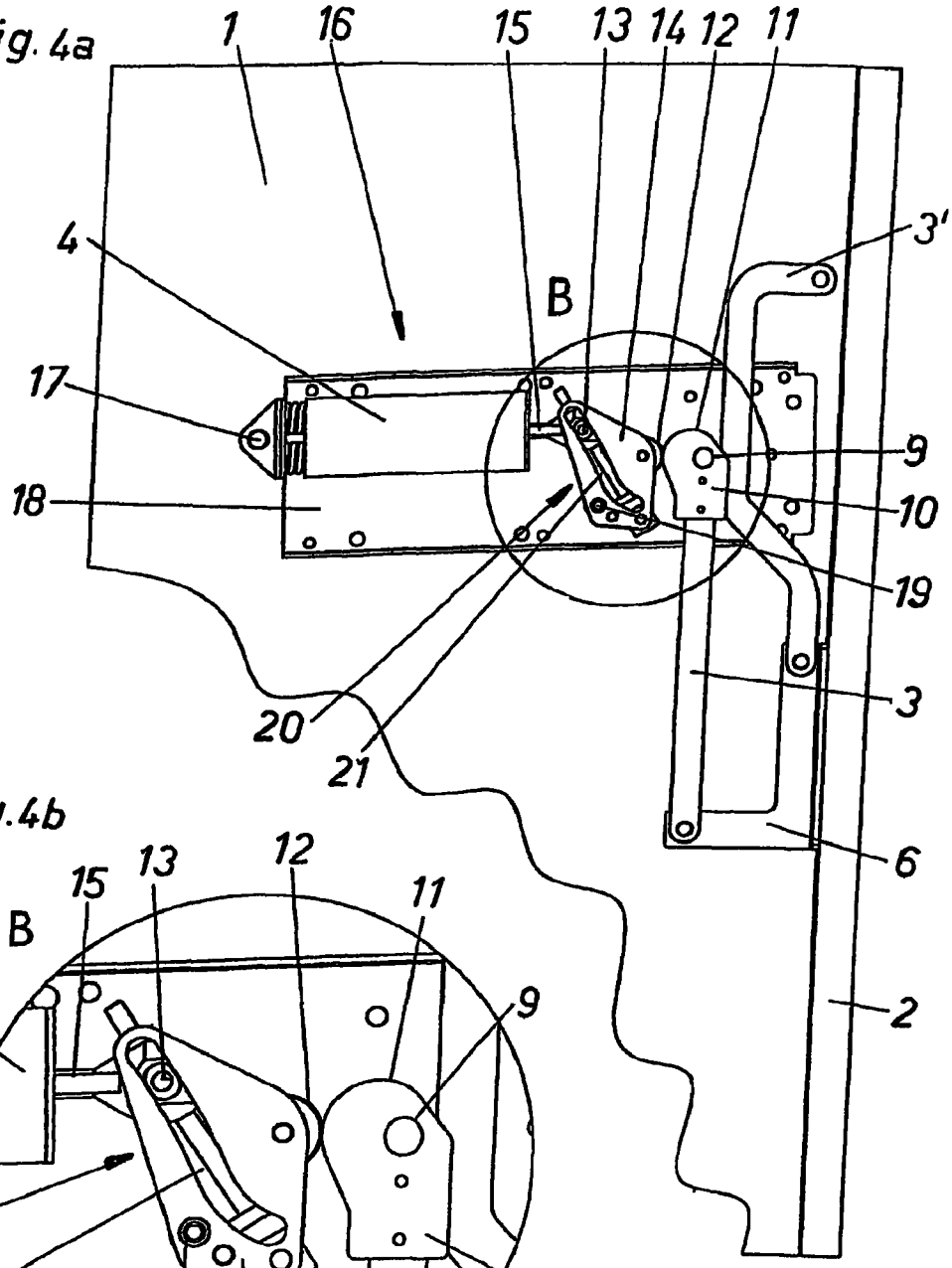
Figure 4B:
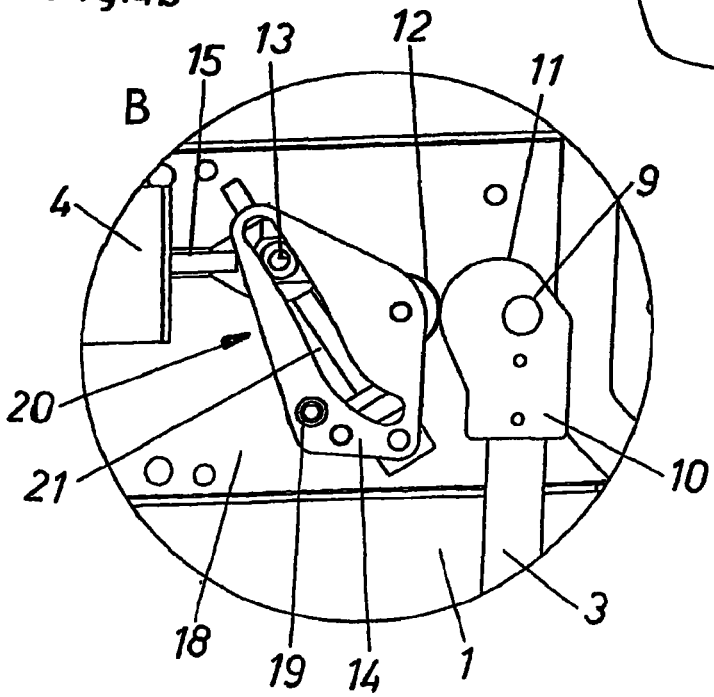
Figure 5:
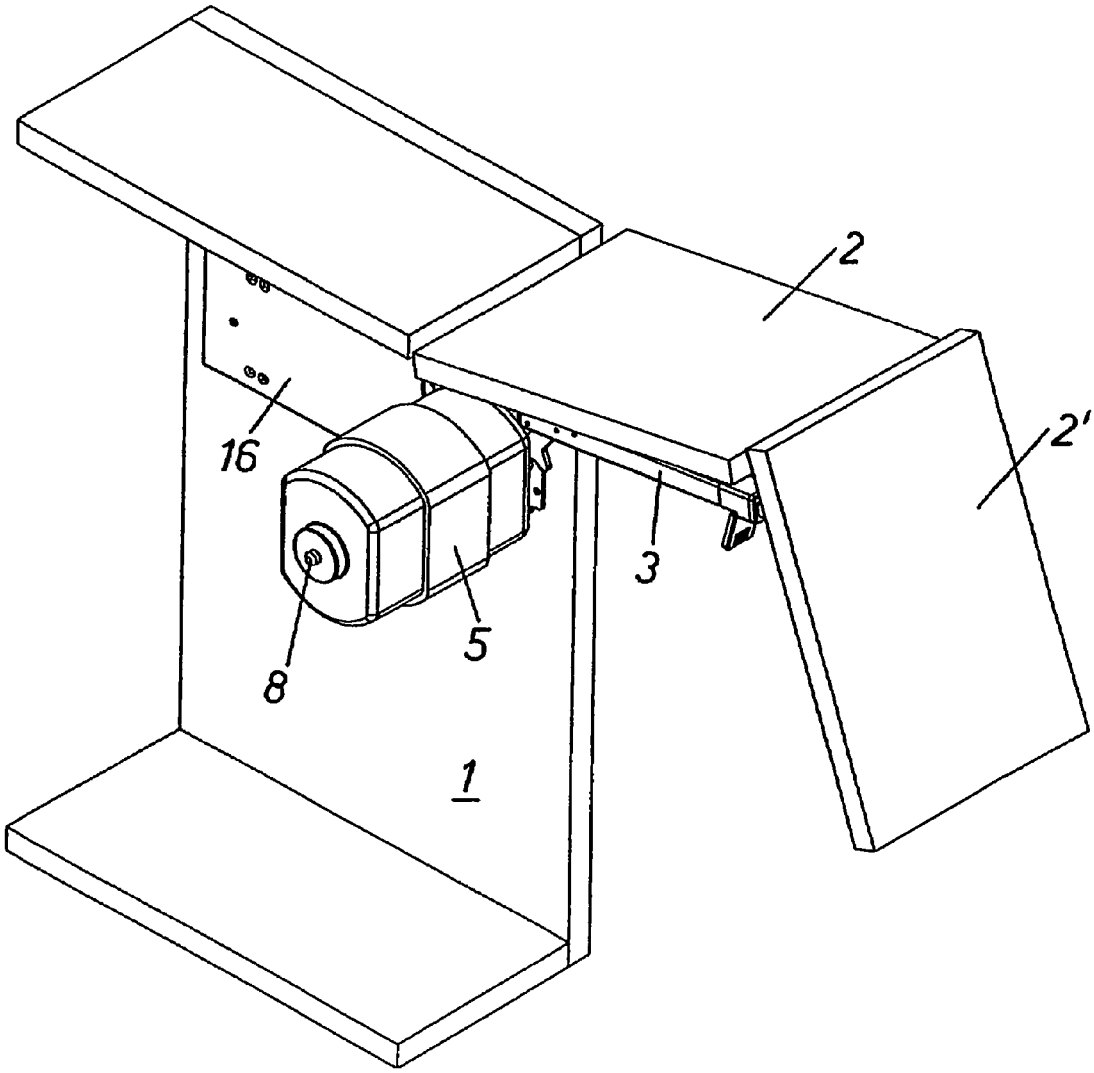
Figure 6:
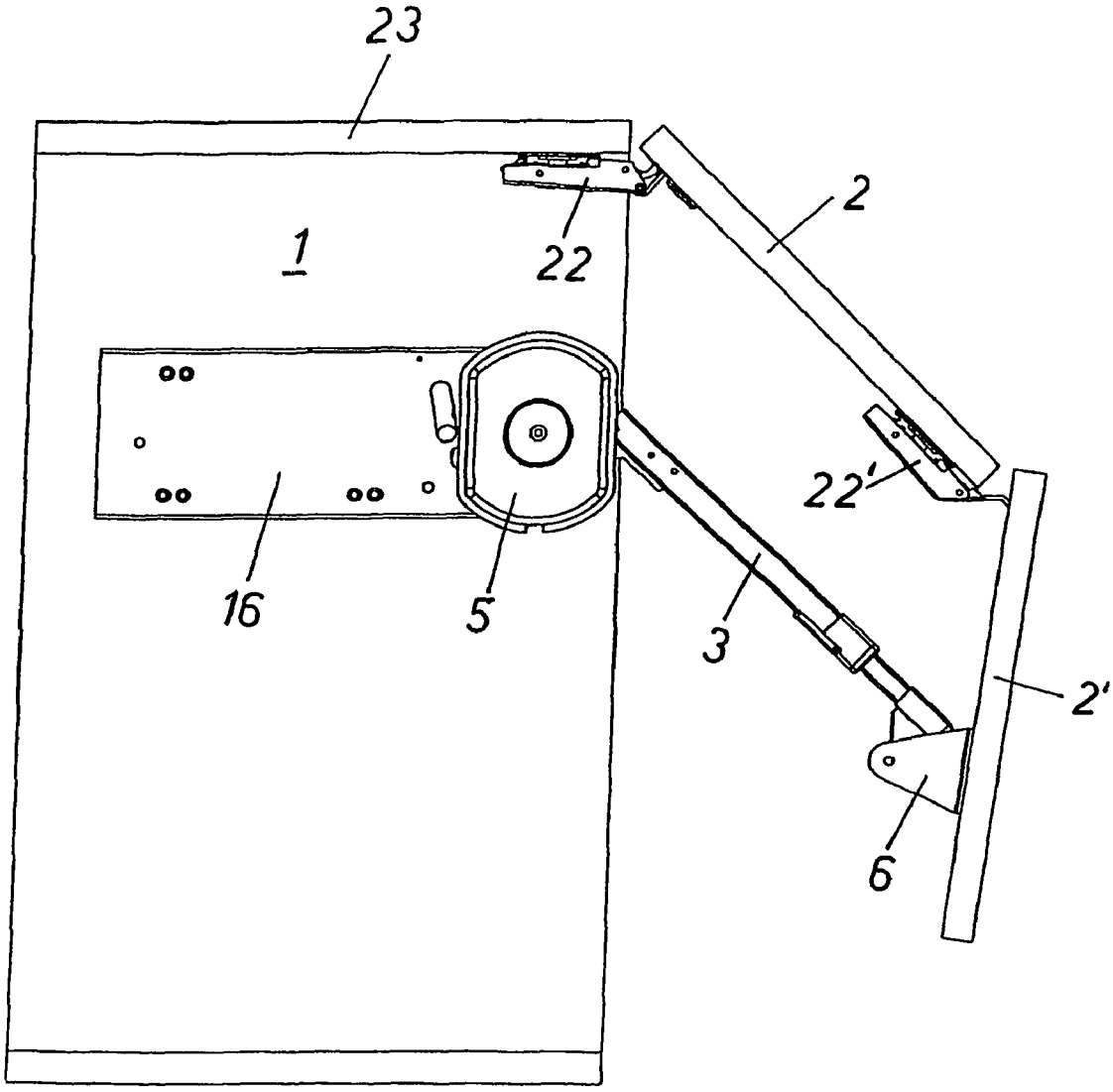
Figure 7:
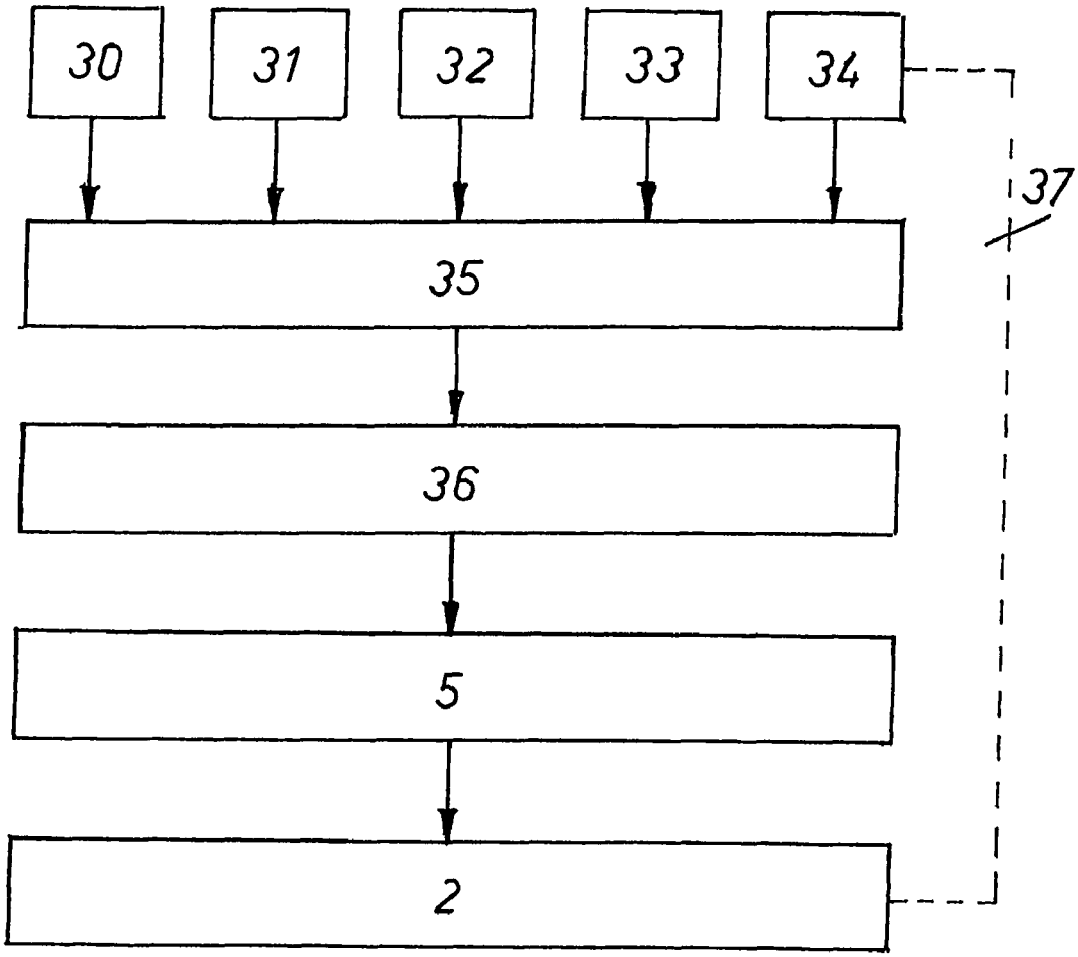
Figures 8A, 8B, 8C:
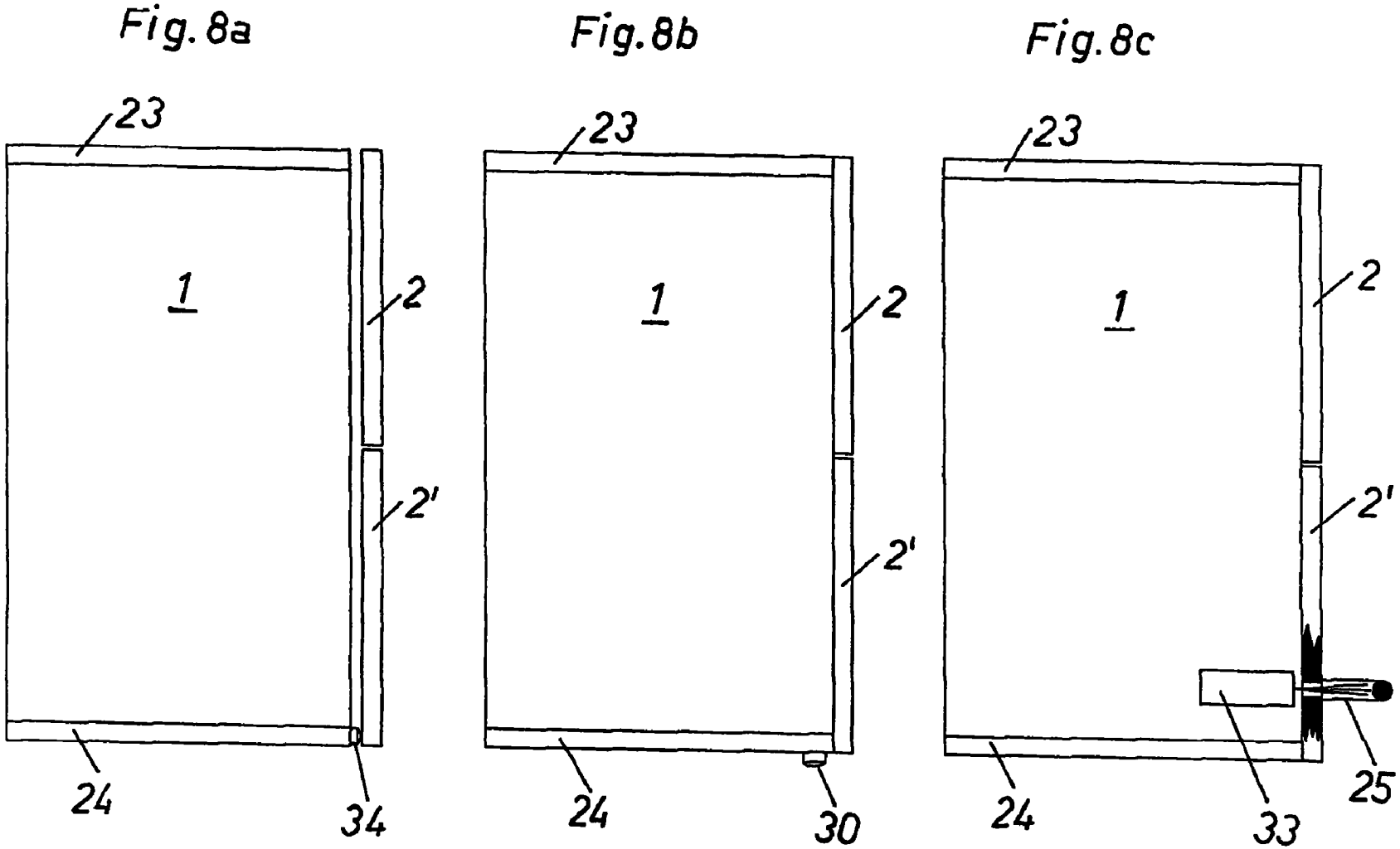
Figure 9A:
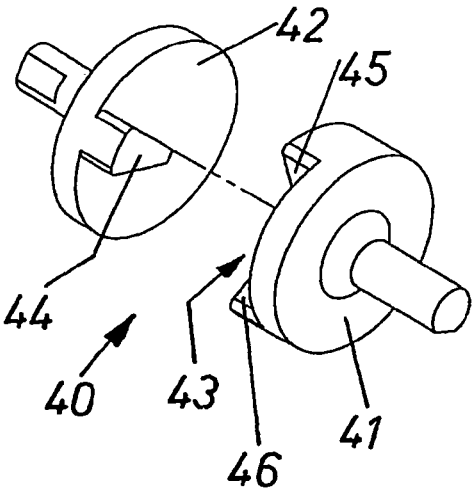
Figure 9B:
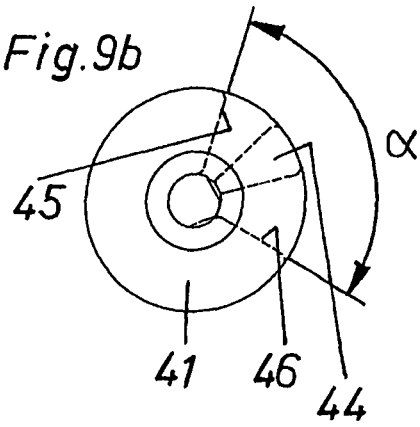
Figure 9C:
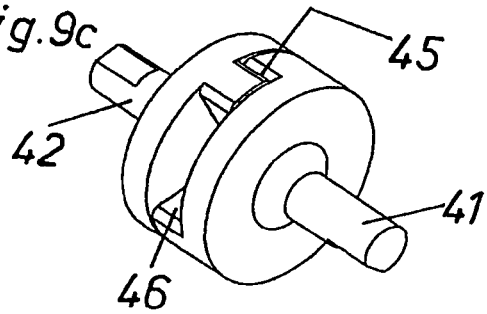
Figure 9D:
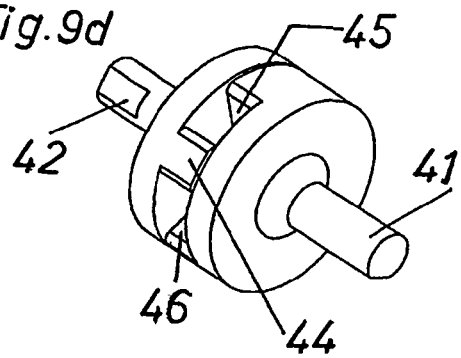
Figure 9E:
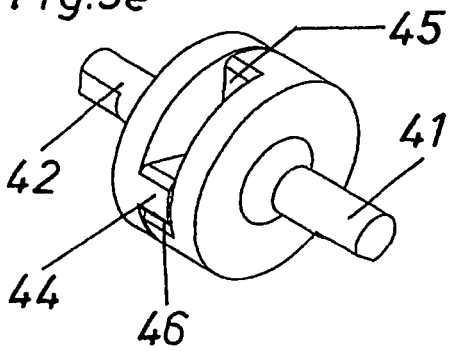
Figure 10:
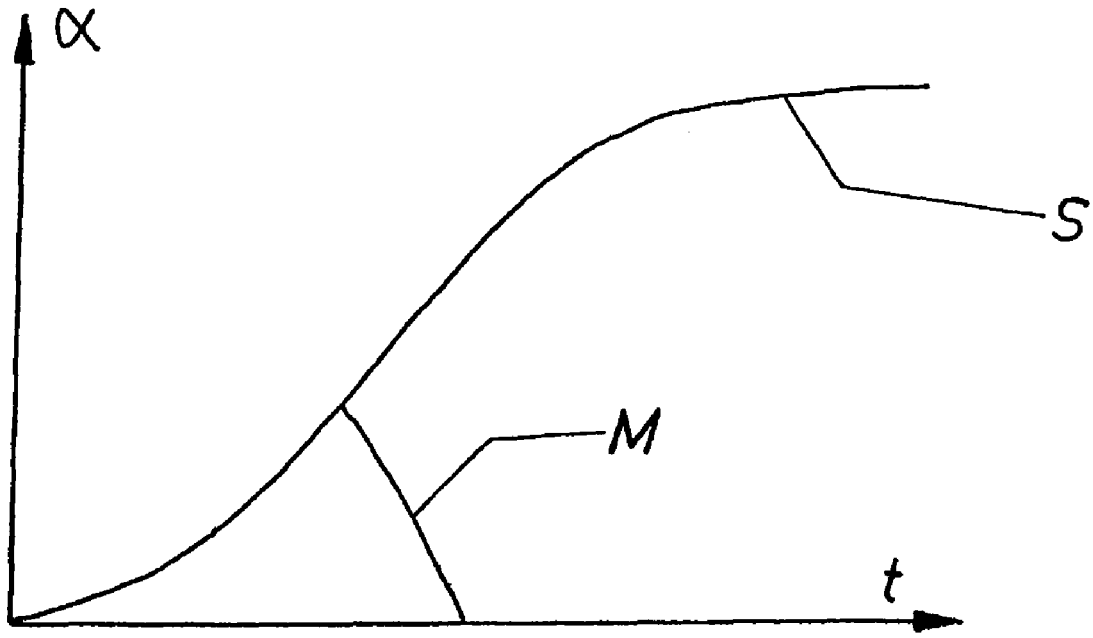
Figure 11:
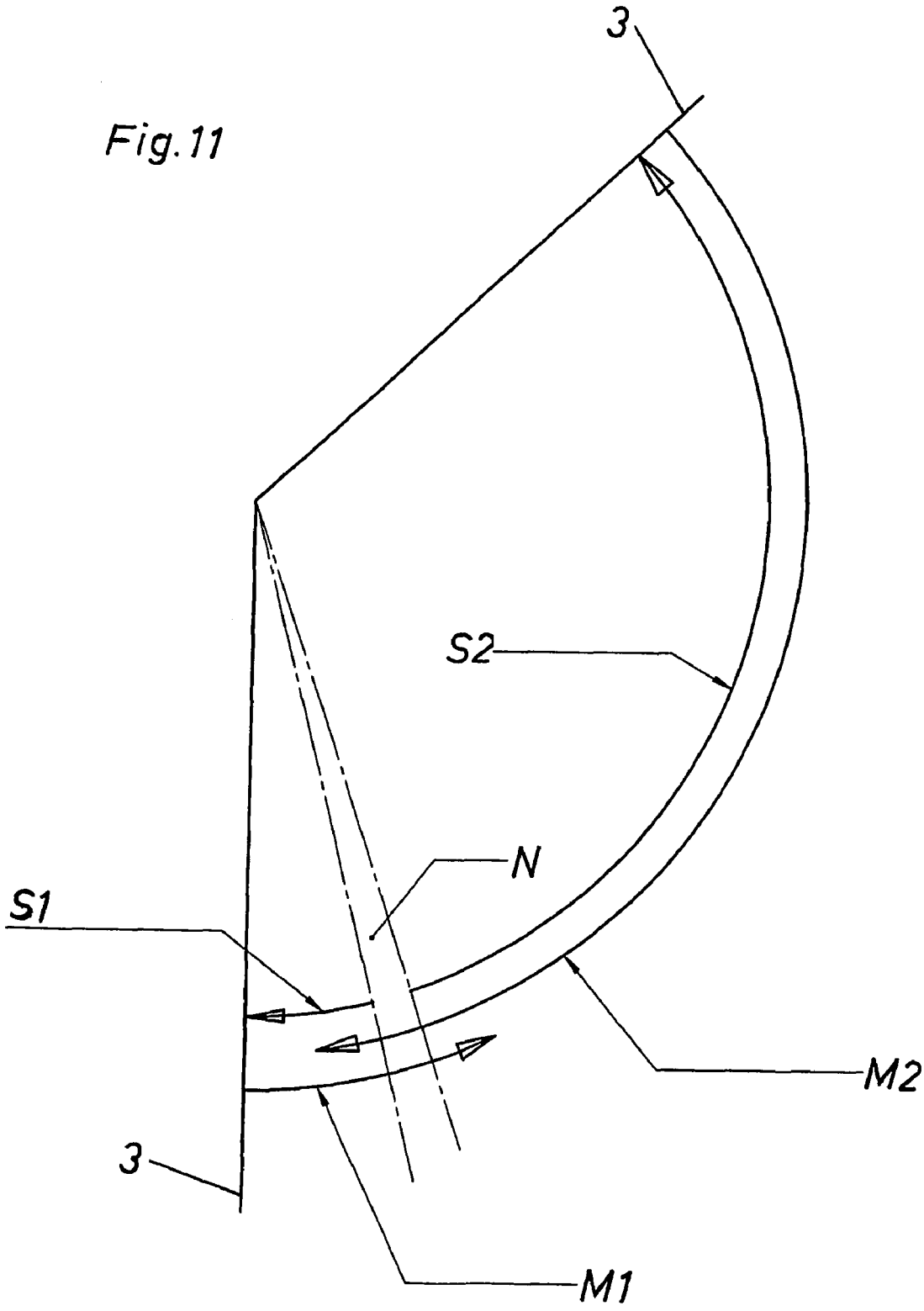

FIG. 1 is a schematic representation of an embodiment of the invention with an upwardly movable flap, FIGS. 2*a*, 2*b* is a side view and a top plan view of the embodiment shown in FIG. 1, FIG. 3 is an exploded representation of the embodiment shown in FIG. 1 and FIG. 2, FIGS. 4*a*, 4*b* is an embodiment of the actuating device with an adjustable spring device for moving the flap, FIG. 5 is a further embodiment of the invention with a motorised actuating device for moving a bi-fold flap, FIG. 6 is a side view of the embodiment shown in FIG. 5, FIG. 7 is an example of a block circuit diagram of the possible forms of activation, FIG. 8*a*-8*c* is various possible methods of activation of the electric drive, FIG. 9*a*-9*e* is an exemplary embodiment of a coupling device for connecting the electrical drive with the actuating arm, FIG. 10 is a graphic representation of the opening motion of the actuating arm and of the pivotal motion of the electric drive as a function of time, and FIG. 11 is a representation of the operative angle ranges of the electric drive and of the spring device.

DETAILED DESCRIPTION OF THE INVENTION

FIG. 1 shows a schematic perspective view of a side wall 1 of an item of furniture. To the side wall 1 an assembly plate 7 with a spring device 4 is attached, wherein the spring device 4 acts upon at least one actuating arm 3 with a torque. In FIG. 1, the spring device 4 is only represented diagrammatically and can operate on actuating arm 3 such that the flap 2 which is connected by a fitting 6 is essentially retained in any pivotal position against the force of gravity. In order to fully balance the flap 2 according to its size and weight, spring device 4 is adjustable in order for the force applied to the actuating arm 3 to be varied. In order to control the movement of the flap 6, another actuating arm 3' is provided which is connected on one side to assembly plate 7 and to fitting 6 of flap 2 on the other side. In order to support the movement process of flap 2 at least partially, electric drive 5 is provided which is connected to bearing axis 8. A preferred embodiment provides for bearing axis 8 to be directly connected to the bearing axis of actuating arm 3 or to be at least temporarily able to be connected to the latter by a transmission gear which is not shown. This has the advantage that the force required to move the flap can be reduced to a minimum due to being well balanced by spring device 4. This means that minimal sizes of electric drives 5 can be used which also can be arranged within the casing of an actuating device.

FIG. 2*a* shows the embodiment shown in FIG. 1 in a side view, FIG. 2*b* shows a top plan view of this arrangement. For the sake of clarity, spring device 4 which is shown in FIG. 1 is not depicted. FIG. 2*a* shows the flap 2 connected to actuating arms 3, 3' in its function as a swivel flap, where it can be swung backwards across the furniture body. It can be seen from FIG. 2*b* that a control cam 10 is connected or formed onto one end of actuating arms 3, 3', said control cam 10 being pivotably arranged on a bearing axis 9 on assembly plate 7. In the embodiment shown, bearing axis 9 of actuating arm 3 corresponds to bearing axis 8 of electric drive 5.

FIG. 3 shows an exploded view of the embodiment shown in FIG. 1 and FIG. 2. Assembly plate 7 is firmly screwed to side wall 2 of an item of furniture. Both actuating arms 3, 3' are connected to assembly plate 7 in an articulated manner, where actuating arm 3 is coupled to its end with control cam 10. Control cam 10 comprises a control contour 11 which can run along a pressure roller (not shown) which is again directly or indirectly pressurised by a spring device 4.

FIG. 4*a* shows a schematic embodiment of an adjustable actuating device 16 in side view, FIG. 4*b* shows the detail B from FIG. 4*a*. For reasons of clarity, electric drive 5 which operates on actuating arm 3 is not shown. Flap 2 which can be pivoted about a horizontal axis is in a closed position. Actuating device 16 comprises a base structure 18 on which actuating arm 3 is pivotally located on bearing axis 9. Second actuating arm 3' is coupled to side wall 1 of the furniture body. Spring device 4 is located on pivoting axis 17 and comprises a compression spring package which includes at least one or more compression springs—preferably parallel switched. Spring device 4 pressurises a displaceable setting part 15 with a force, wherein working point 13 is moved corresponding to the pressure of spring device 4. Adjusting device 20 converts the (linear) motion of setting part 15 into a pivotal motion of intermediate lever 14. Intermediate lever 14 comprises a guide path 21 along which working point 13 can be adjustably located. By adjusting working point 13 in this way, the force of pressure roller 12 on control contour 11 of control cam 10 can be set. Electric drive 5 may be connected directly or indirectly to bearing axis 9 of control cam 10. Actuating device 16 as shown is only represented as an example and in principle it can comprise all the other known solutions in accordance with the state of the art.

FIG. 5 shows a perspective view of an item of furniture on side wall 1 of which is connected actuating device 16. Electric drive 5 is arranged so that it acts upon actuating arm 3. Flap 2 can be pivoted about a horizontal axis with respect to the furniture body. A second flap 2' is pivotally located about a horizontal axis on flap 2. In the figure shown, actuating arm 3 is connected to lower flap 2'.

FIG. 6 shows a side elevation of the embodiment shown in FIG. 5. Actuating device 16, which is supported by motorised electric drive 5, is provided in order to move a bi-fold flap having part flap 2 and part flap 2'. Upper part flap 2 is pivoted about a horizontal axis in relation to the furniture body. For this, at least two hinges 22 are provided which are attached on the one hand to the lower section of cupboard cover 23 and on the other hand to flap 2. Lower part flap 2' is connected to the lower section of upper part flap 2 by means of a two- or multi-dimensional hinge 22'. Actuating arm 3 is connected to lower part flap 2' by fitting 6 for easy movement of flaps 2 and 2'. Motorised drive 5 can support the movement of part flaps 2 and 2' from the fully closed position to the fully open position or vice-versa for at least part of this movement path. As an advantage, electric drive 5 can also be used as a device to dampen the motion of flaps 2 and 2'.

FIG. 7 shows a schematic block circuit diagram of various ways for activating electric drive 5. As examples, switch device 30 (e.g. a push button switch), an optical detecting device 31 (e.g. a camera), a speech recognition device 32 (e.g. a microphone), a sensor device 33 (e.g. distance sensors) and a Touch-Latch device 34 are provided which can be arranged either individually or in any possible combination with each other. Touch-Latch device 34 operates together with flap 2 by control lead 37, wherein Touch-Latch device 34 can be activated by pulling or pressing flap 2. An activation device 35 assesses the signals of devices 30-34 referred to above and directs these to a control and regulating device 36 which in turn can control electric drive 5 and also flap 2 in accordance with a selectable operating mode.

FIG. 8*a*-8*c* show various embodiments of activation of electric drive 5. Each of the representations shows views onto side wall 1 of an item of furniture with a bi-fold flap being upwardly movable, said bi fold flap comprises two part flaps 2 and 2'. FIG. 8*a* shows an activation with a switching Touch-Latch device 34 between lower part flap 2' and cupboard base 24, whereby electric drive 5 is activated by manual pressure on lower part flap 2'. FIG. 8*b* shows an alternative form where activation takes place upon operating switch device 30. FIG. 8*c* shows sensor device 33 which registers the operation of a handle component 25 and so activates electric drive 5.

FIG. 9*a*-9*e* show an exemplary embodiment of coupling the electric drive 5 and actuating arm 3. A coupling device 40 comprises of two substantially disc-shaped coupling elements 41 and 42 which are arranged coaxially relative to one another and which permit at least a temporary connection between electric drive 5 and actuating arm 3. The first coupling element 41 can be connected with the electric drive 5, while the second coupling element 42 is connected with actuating arm 3. The first coupling element 41 has a circular sector shaped opening 43 with a stop 45 and a counter-stop 46. The second coupling element 42 comprises a lug 44 which can engage into opening 43, provided that the coupling elements 41, 42 are in a coupled position. Lug 44 is freely movable between stop 45 and counter-stop 46. FIG. 9*b* shows a vertical cross section through both coupling elements 41 and 42. The opening 43 has an opening angle $\alpha$ which substantially corresponds to the angular movement of actuating arm 3, so that flap 2 can be moved from the closed position to the fully open position thereof. Said opening angle $\alpha$ also corresponds to the angular movement of electric drive 5. This figure shows that wedge-shaped lug 44 can be moved between stop 45 and counter-stop 46 of first coupling element 41.

FIG. 9*c*-9*e* each show perspective views of both coupling elements 41 and 42, where lug 45 in opening 43 can be guided between stop 45 and counter-stop 46. First coupling element 41 is connected to electric drive 5 while second coupling element 42 is connected to actuating arm 3 of flap 2. FIG. 9*c* corresponds to the closed position of flap 2 where lug 44 abuts to stop 45. When electric drive 5 is now activated, coupling element 41 is turned in an anti-clockwise direction. If the weight of flap 2 is ideally fully compensated by the spring device 4 as described in FIGS. 4*a*, 4*b*, a slight (turning) movement of first coupling element 41 across a partial range of opening angle $\alpha$ is sufficient for the second coupling element 42 and its lug 44 to be released from stop 45 and then to move freely in the direction of counter-stop 46. FIG. 9*d* shows lug 44 released from stop 45 which is now located about half-way within opening angle $\alpha$ (corresponding to the half open position of flap 2). Electric drive 5 then returns coupling element 41 back to its initial position and lug 44 abuts to counter-stop 46 as shown in FIG. 9*e*. FIG. 9*e* therefore corresponds to the fully open position of flap 2. The closing process can be analogously deduced in the sequence of FIG. 9*e*, FIG. 9*d* and FIG. 9*c*. When the weight of flap 2 is ideally compensated, a clockwise turning impulse of electric drive 5 is sufficient to release lug 44 from counter-stop 46 and to move it freely in the direction of stop 45. In order to avoid lug 44 from striking hard against stop 45 or counter-stop 46, these stops 45, 46 can be fitted with attenuating shock absorbing supports (for example soft rubber pads) so that any banging noises which arise can be reduced.

FIG. 10 shows a diagram of opening angle $\alpha$ of actuating arm 3 (characteristic curve S) and the turning motion of electric drive 5 (characteristic curve M) as a function of time. Electric drive 5 initially turns together with lug 45 (identical path of characteristic curves M and S), however, after a slight turning movement across a partial section of opening angle $\alpha$, electric drive 5 returns to its initial starting position, flap 2 though is automatically moved to the fully open position or vice-versa due to the balance-compensation of weight attained by spring device 4.

FIG. 11 shows the operative angle ranges of electric drive 5 and spring device 4 during the pivotal movement of actuating arm 3. The vertical line corresponds to the closing position of actuating arm 3, while the line which points obliquely upwards identifies the fully open position of actuating arm 3 or of flap 2. Actuating arm 3 is pressurised by spring device 4 radiant from a neutral position N lying between these two end positions of flap 2 on one side in a first pivoting range S2 towards the external end position and is likewise pressurised by spring device 4 radiant from this neutral position N in a second pivoting range S1 to the internal end position. If flap 2 is transferred from the closed position towards the open position, neutral position N shall be exceeded so that from this time actuating arm 3 is pressed towards the fully open position by spring device 4. Moreover, actuating arm 3 is pressed vice-versa from the fully open position of adjustable arm 3 into the closed position once neutral position N has been passed. In addition, provision is made for electric drive 5 to be active in the opening process of flap 2, radiant from the fully closed position of flap 2 across an angle range M1 of maximum 50°, preferably of maximum 30°, towards the open position. With the aid of electric drive 5, actuating arm 3 is moved beyond neutral position N, where from this time electric drive 5 is preferably no longer active and actuating arm 3 or flap 2 can be moved on its own into the fully open position by spring device 4. Vice-versa, in the closing process of flap 2, electric drive 5 is active radiant from the fully open position of flap 2 across a angle range M2 of maximum 100°, preferably of maximum 80°, towards the closed position. Electric drive 5 supports the closing process of flap 2 beyond neutral position N so that actuating arm 3 is moved freely into the closed position, without further aid of electric drive 5, but by being pressurised by spring device 4.

Coupling device 40 is advantageously designed such that the maximum opening angle of actuating arm 3 or of flap 2 can be adjusted. The position of coupling device 40 shown in FIG. 9*a* to 9*e* with coupling elements 41 and 42 can be detected by an electronic measuring device, the signals of which can be directed to control and regulation device 36.

The present invention is not limited to the embodiments shown, but includes or extends to all variants and technical equivalents which can fall within the scope of the following claims. The positional details which have been selected in the description (such as top, bottom, lateral or the like) refer to the usual installation position or to the figure directly described and illustrated and in the event of a change of position may be correspondingly transferred to the new position. Actuating arm 3 can, for example, also be designed as a gear rack which meshes with a pinion on electric drive 5. The invention is identified by a simple and smooth fitting system which by the use of the free-wheel coupling device described and in conjunction with an ideal weight compensation of flap 2 requires a minimum degree of power from electric drive 5, since a turning impulse of electric drive 5 will suffice to transfer the necessary torque for the opening or closing movement. The electrical performance of the motor can, for example, be determined at 20 W to 40 W, where an impulse time of 0.5 to 1.0 seconds has been shown to be favourable. If the electric drive 5 is active across the entire pivotal path of actuating arm 3 or of flap 2, the performance dimensions of the motor shall be correspondingly less, for example from 4 W to 5 W. The performance data of electric drive 5 are, however, dependent on the friction values of the complete system, in particular on the selective setting of spring device 4. In addition to control and regulation device 36 (which can be designed as hardware and/or software), a start-up coupling device and an overload connection device, for example a coil spring device which operates on coupling device 40, can be supplied.

The invention claimed is:

1. An item of furniture comprising:

a furniture body;

a flap being upwardly movable relative to said furniture body;

an actuating arm connected to said flap, said actuating arm being movable across a range of motion between an open position and a closed position;

a spring device for moving said actuating arm;

an electric drive for moving said actuating arm; and a coupling device coupling said electric drive to said actuating arm, said coupling device allowing said actuating arm to move freely across a limited pivoting range between the open position and the closed position in at least one direction of movement, wherein said electric drive is operable to drive said actuating arm only over a first partial range of said range of motion of said actuating arm, wherein said coupling device is configured to allow said actuating arm after having passed said first partial range to be moved further over a second partial range of said range of motion without further support from said electric drive, and wherein said first partial range begins at one of the open position and the closed position of the actuating arm and ends at an end position beyond a neutral position of the actuating arm, and said second partial range begins at the neutral position and ends at the other of the open position and the closed position of the actuating arm.

2. The furniture of claim 1, wherein said actuating arm is pivotable about a horizontal axis.

3. The furniture of claim 1, wherein said actuating arm is operably connected to said flap such that said flap is moved between an open state and a closed state as said actuating arm moves between the open position and the closed position, and wherein said electric drive moves said actuating arm in an opening process of said flap starting from the closed state of said flap across a maximum angle range of 50° towards the open state of said flap.

4. The furniture according to claim 3, wherein said maximum angle range is 30°.

5. The furniture according claim 1, wherein said actuating arm is operably connected to said flap such that said flap is moved between an open state and a closed state as said actuating arm moves between the open position and the closed position, and wherein said electric drive moves said actuating arm in a closing process of said flap starting from the open state of said flap across a maximum angle range of 100° towards the closed state.

6. The furniture according to claim 5, wherein said maximum angle range is 80°.

7. The furniture according to claim 1, wherein said flap is upwardly movable relative to said furniture body between an external end position and an internal end position, said flap being configured such that a neutral position exists between the external end position and the internal end position, and wherein said actuating arm is pressurised by said spring device from the neutral position on one side of the neutral position in a first pivoting range towards the external end position and is likewise pressurised by said spring device from said neutral position in a second pivoting range to the internal end position.

8. The furniture according to claim 1, wherein said spring device is configured to act upon said actuating arm such that said flap is substantially retained in any pivotal position against the force of gravity.

9. The furniture according to claim 1, wherein said spring device is adjustable to vary the torque applied to said actuating arm.

10. The furniture according to claim 1, wherein said electric drive is configured such that torque applied to said actuating arm by said electric drive to open said flap is substantially equal to the moment of inertia of said flap multiplied by an angular acceleration of said flap which is to be attained.

11. The furniture according to claim 1, wherein an actuating device is provided to move said flap, wherein said actuating device comprises a base structure to be attached to said furniture body, wherein said actuating arm is pivotally connected on one side to said base structure and on the other side pivotally connected to said flap.

12. The furniture according to claim 11, wherein said actuating arm is operably connected to said flap such that said flap is moved between an open state and a closed state as said actuating arm moves between the open position and the closed position, and wherein said actuating device is operable to move said flap starting from each of said open state and said closed state.

13. The furniture according to claim 11, wherein said actuating arm is supported on a bearing axis on said base structure.

14. The furniture according to claim 13, wherein said electric drive is arranged substantially coaxially to said bearing axis of said actuating arm.

15. The furniture according to claim 1, wherein said flap constitutes a first flap, and a second flap is provided which is pivotably arranged about a horizontal axis on said flap.

16. The furniture according to claim 15, wherein said actuating arm is articulated to said second flap.

17. The furniture according to claim 1, wherein said flap can be moved from an open state to a fully closed state by said electric drive across at least one section of a closing path.

18. The furniture according to claim 1, wherein said flap can be moved to a fully open state by said electric drive across at least one section of an opening path.

19. The furniture according to claim 1, further comprising a switch device, said switch device being operable to activate said electric drive.

20. The furniture according to claim 19, wherein said switch device is disposed in a manner selected from the group consisting of: fitted on said item of furniture; fitted in said item of furniture; and spatially outside said item of furniture.

21. The furniture according to claim 1, wherein said electric drive is configured to be activated by moving said flap manually.

22. The furniture according to claim 21, wherein said electric drive is configured to be activated by said flap being pulled or pressed.

23. The furniture according to claim 1, further comprising a sensor device, wherein said electric drive is configured to be activated by said sensor device.

24. The furniture according to claim 1, further comprising a speech recognition device, wherein said electric drive is configured to be verbally activated by said speech recognition device.

25. The furniture according claim 1, further comprising an optical detecting device, wherein said electric drive is configured to be activated by said optical detecting device.

26. The furniture according to claim 1, wherein said electric drive comprises an electric motor or a direct current motor.

27. The furniture according to claim 1, wherein an interlocking connection or a frictional lock connection between said electric drive and said actuating arm can be attained by said coupling device.

28. The furniture according to claim 1, wherein said coupling device comprises two substantially disc-shaped coupling elements which are movable relative to one another.

29. The furniture according to claim 18, wherein said two substantially disc-shaped coupling elements comprise a first coupling element and a second coupling element, and wherein said first coupling element has an opening and said second coupling element has a lug, wherein said lug is engageable in said opening.

30. The furniture according to claim 29, wherein said opening is formed between a stop and a counter-stop, wherein said lug is movable between said stop and said counter-stop.

31. The furniture according to claim 1, wherein said coupling device is adjustable to vary a maximum opening angle of said flap.

32. The furniture according to claim 1, wherein said electric drive can be supplied with power by a power store or a battery.

33. The furniture according to claim 1, wherein at least one damping device is provided for dampening the movement of said flap.

34. The furniture according to claim 33, wherein said electric drive is part of said damping device.

35. The furniture according to claim 34, wherein said damping device dampens the movement of said flap at least across a last portion of a closing path of said flap.

36. The furniture according to claim 1, wherein the first partial range begins at the closed position of the actuating arm and the second partial range ends at the open position of the actuating arm.

37. The furniture according to claim 1, wherein the first partial range begins at the open position of the actuating arm and the second partial range ends at the closed position of the actuating arm.

38. An item of furniture comprising:

a furniture body;

an actuating arm connected to said furniture body, said actuating arm being movable across a range of motion between an open position and a closed position;

a flap connected to said actuating arm such that said flap moves relative to said furniture body between an open state and a closed state as said actuating arm moves between the open position and the closed position;

a spring device for moving said actuating arm;

an electric drive for moving said actuating arm; and a coupling device coupling said electric drive to said actuating arm, said coupling device allowing said actuating arm to move freely across a limited pivoting range between the open position and the closed position in at least one direction of movement, wherein said electric drive is operable to move said actuating arm only over a first partial range of said range of motion of said actuating arm, wherein said spring device is operable to move said actuating arm over a second partial range of said range of motion without further support from said electric drive, and wherein said first partial range and said second partial range collectively constitute a full range of motion between the open position and the closed position of the actuating arm.

39. An item of furniture comprising:

a furniture body;

an actuating arm connected to said furniture body, said actuating arm being movable across a range of motion from an open position to a closed position;

a flap connected to said actuating arm such that said flap moves relative to said furniture body between an open state and a closed state as said actuating arm moves between the open position and the closed position;

a spring device for moving said actuating arm;

an electric drive for moving said actuating arm; and a coupling device coupling said electric drive to said actuating arm, said coupling device comprising a first coupling element and a second coupling element being movable relative to said first coupling element, wherein said first coupling element includes a stop and a counter-stop, an opening being formed between said stop and said counter-stop, and said second coupling element includes a lug, said lug being engaged in said opening and movable between said stop and said counter-stop, wherein said coupling device is coupled to said actuating arm such that said actuating arm is freely movable across a limited pivoting range between the open position and the closed position by means of said lug moving between said stop and said counter-stop, wherein said electric drive is operable to move said actuating arm only over a first partial range of said range of motion of said actuating arm, wherein said spring device is operable to move said actuating arm over a second partial range of said range of motion without further support from said electric drive, and wherein said first partial range and said second partial range collectively constitute a full range of motion between the open position and the closed position of the actuating arm.

40. The furniture according to claim 39, wherein said coupling device is configured such that said lug is in contact with one of said stop and said counter-stop as said electric drive moves said actuating arm over said first partial range of said range of motion, and said lug moves between said stop and said counter-stop as said spring device moves said actuating arm over said second partial range of said range of motion.

* * * * *